US005080243A

United States Patent [19]

Lynch, Jr. et al.

[11] Patent Number: 5,080,243

[45] Date of Patent: Jan. 14, 1992

[54] ASSEMBLY MECHANISM FOR AN ARTICULATED COUPLING SYSTEM

[75] Inventors: Edward G. Lynch, Jr., Saugus, Calif.; David W. Daugherty, Jr., Bolingbrook; Wajih Kanjo, Lockport, both of Ill.; Michael G. Hawryszkow, Munster, Ind.; William D. Wallace, Indian Head Park, Ill.

[73] Assignee: Westinghouse Air Brake Company, Wilmerding, Pa.

[21] Appl. No.: 586,570

[22] Filed: Sep. 21, 1990

[51] Int. Cl.[5] ..... B61G 5/00

[52] U.S. Cl. ..... 213/75 R; 105/3; 213/62 R; 384/209; 403/57

[58] Field of Search ..... 105/3, 4.1, 4.2; 213/50, 62 R, 74, 75 R; 280/511; 180/134; 384/206, 208, 209; 403/57, 122, 157; 464/170, 173

[56] References Cited

U.S. PATENT DOCUMENTS

| | | | |
|---|---|---|---|
| 3,806,158 | 4/1974 | Casey | 403/157 X |
| 4,243,192 | 1/1981 | Johnson | 384/208 X |
| 4,258,628 | 3/1981 | Altherr | 105/4 R |
| 4,593,829 | 6/1986 | Altherr | 213/75 R |
| 4,766,980 | 8/1988 | Engle | 403/157 X |
| 4,867,071 | 9/1989 | Weber | 105/4.1 |

*Primary Examiner*—Robert J. Oberleitner
*Assistant Examiner*—S. Joseph Morano
*Attorney, Agent, or Firm*—Armstrong, Nikaido, Marmelstein, Kubovcik & Murray

[57] ABSTRACT

An assembly mechanism is provided for removably securing a bearing assembly carried by a male connection member to a female connection member of an articulated coupling system. Such assembly mechanism includes at least one vertically disposed lug member secured to an outer surface of a vertically disposed side wall of a cavity formed in one end of such female connection member adjacent an opening formed in such side wall portion. There is at least one horizontally disposed lug member secured to such outer surface adjacent another portion of such opening in such side wall portion. A locking member is engageable with each of such vertical lug member and such horizontal lug member and a portion of a shaft-like member extending outwardly from such bearing assembly. The locking member removably secures such shaft-like member against rotation in such opening. A locking device is engageable with such locking member and such vertical lug member and such horizontal lug member which locks such locking member in a secure manner to such verticl lug member and such horizontal lug member.

40 Claims, 3 Drawing Sheets

ASSEMBLY MECHANISM FOR AN ARTICULATED COUPLING SYSTEM

FIELD OF THE INVENTION

The present invention relates, in general, to railway car-type articulated coupling arrangements which connect a first predetermined end of a first railway car to an adjacent predetermined end of a second railway car in a substantially semi-permanent manner and, more particularly, this invention relates to an assembly mechanism for connecting a male connection member to a female connection member in such semi-permanent manner and which after such connection the articulated coupling arrangement enables all standard railway cars, that are in use in the railroad industry at this time, to negotiate all known curves presently in use in the various track structures.

BACKGROUND OF THE INVENTION

In the railroad industry it is well known, prior to the present invention, to use standard railcar couplers. These couplers are used to connect adjacent ends of a pair of railway cars together to form a train consist. It is also known that these couplers have been approved for service in interchange by the Association of American Railroads (AAR). In this application, for example, these standard couplers were generally designed in a manner such that both the connecting together and disconnecting of individual railway cars could be readily accomplished. In addition, these standard couplers enable the train consist to be made in an expeditious manner. Further, such standard couplers enable individual railcars to be easily separated to facilitate their loading and unloading as necessary during service.

However, in more recent times, it has been discovered by the railroad industry that the interconnecting together of a number of railway cars to form a generally semi-permanent unit will achieve a number of distinct advantages. When, for example, such railroad cars are particularly adapted for use in what is known in the industry as "piggyback" service and have been joined together in this manner, such advantages are readily achieved. Such railroad cars which have been joined in this generally semi-permanent fashion are commonly referred to in the railroad industry as a "10-pack." As is well known, these 10-pack units do not require the use of such standard railway couplers discussed above except between units. In other words, on each end of such 10-pack units. Because such 10-pack units are normally only broken on a periodic basis, is the primary reason why the use of these standard railway couplers is not required. In practice, these 10-pack units will only be broken when either maintenance or replacement of either an individual coupling component or some other car component must be carried out. It is, therefore, obvious that by this arrangement considerable cost-savings can be achieved by the railroad industry. These cost-savings, for example, are primarily derived from lower weight which will improve fuel efficiency, fewer railway trucks, reduced maintenance, and lower equipment cost. Such lower weight and reduced equipment cost being derived, in part, by substantially reducing the need for draft gears and the number of railway car trucks required in such 10-pack units.

With the ever increasing use of these normally semi-permanent coupling arrangements and with the need for heavier loads to be carried by modern railway service, it has been recognized that it is of the utmost importance for a close-buttoned relationship to be maintained between the coupler draft components during service on the track structure. Such close-buttoned relationship is required in order to achieve a reduction in the effects of the impact forces which are normally encountered under buff conditions of train operations.

In U.S. Pat. No. 4,258,628 one of the prior art type articulated coupling arrangements is taught. This articulated coupling arrangement is used to interconnect adjacent ends of a pair of railway cars together in a semi-permanent manner to form a 10-pack. This particular articulated coupling device includes a male connection member which is secured to a first end of a first railway car body member and a female connection member which is secured to an adjacent end of a second railway car body member. The female connection member, in this coupling arrangement, is rotatably engaged in a center plate bowl portion of a bolster member of a railroad car truck. This rotatable engagement is carried out in a manner that is well known in the railway art. The outer end of the male connection member is positioned for relative movement in a cavity that is formed in the outer end of such female connection member. Both the male connection member and the female connection member are joined, in such semi-permanent manner, by a pin member. As taught in this prior art reference, such pin member is positioned in a vertical direction and is disposed in vertically aligned apertures formed in each of such male connection member and such female connection member. The vertically disposed aperture formed in the outer end of the male connection member for receiving such pin member therein must be somewhat larger than the pin member itself in order to allow certain movements such articulated coupling arrangement will be required to make. A rear surface portion of the aperture formed in such male connection member which receives the pin member therein has a concave configuration in a horizontal direction and a convex configuration in a vertical direction. This particular configuration will enable both the male connection member and the female connection member to move in relationship to one another in each of a horizontal direction and a vertical direction. Additionally, this configuration will provide a relatively substantial area of surface contact between the rear surface of the pin aperture and the pin member. Obviously this also provides a relatively substantial surface area which is subjected to frictional wear.

The outer end surface of the outer end portion of such male connection member includes a convex configuration which is positioned to abut against a complimentary concave surface formed on a front face portion of a follower member. In this articulated coupling device, the follower member is carried within the rear portion of the cavity that is formed in the outer end portion of such female connection member. Formed on the rear face portion of such follower member are a pair of vertically disposed slot-like cavities. Each of these vertical slot-like cavities has a resilient element disposed therein. At least a portion of such resilient element protrudes outwardly from such rear face portion of such follower member. The exposed outer surface of each such resilient element is slidably engaged by a vertically disposed wedge-like element. This wedge-like element is provided in this articulated coupling arrangement so that during service such follower member and such male connection member will be urged forward. In this manner, the rear surface portion of the aperture formed in such male connection member will be maintained substantially in intimate contact with the pin member at all times so that minimum slack in such articulated coupling arrangement can be ensured.

Furthermore, such intimate contact has generally been found necessary in these prior art articulated coupling arrangements, because most of the articulated connecting components are cast members. In order to provide any significant reduction in the manufacturing cost of this coupling arrangement, such cast members normally will receive very little, if any, finish type machining to provide either the necessary or the desirable dimensional control. As a result of this lack of finish type machining, it is generally rather difficult to provide an articulated coupling arrangement of this type which will possess the self-adjusting capability required under various wear conditions. Such self-adjusting capability being necessary in order to minimize as much a possible the slack encountered in the various connections during service in a train consist.

Other prior art type articulated coupling arrangements are taught in U.S. Pat. No. 3,716,146 and Canadian Patent number 1,231,078.

SUMMARY OF THE INVENTION

The present invention provides an assembly mechanism which enables a bearing assembly to be removably secured to a female connection member of an articulated coupling arrangement. Such bearing assembly has at least a predetermined portion thereof disposed in and secured to a outer end portion of a male connection member of such articulated coupling arrangement. Such male connection member is engageable with and connectable to a predetermined end of a first railway car at an axially opposed end portion thereof. Such assembly mechanism is secured to at least one of a pair of vertically disposed and axially opposed side wall portions of a cavity disposed at an outer end portion of such female connection member. This female connection member is engageable with and connectable to an adjacent predetermined end of a second railway car at an axially opposed second end portion thereof. The assembly mechanism thereby connecting the adjacent ends of such first railway car and such second railway car together in a substantially semi-permanent manner. Such bearing assembly includes a pair of shaft-like members which extend outwardly a predetermined length from axially-opposed surfaces of a substantially spherical member. Each shaft member is engageable in a respective opening formed through such pair of vertically disposed and axially opposed side wall portions of such cavity. The assembly mechanism, constructed according to the present invention, includes at least one substantially vertically disposed lug member secured to an outer surface of at least one of such vertically disposed side wall portions. Such vertically disposed lug member being secured to such vertically disposed side wall portion adjacent a first predetermined portion of such opening formed therein. Such vertically disposed lug member having a first predetermined length and extends outwardly from such side wall portion for a first predetermined distance. The assembly mechanism also includes at least one substantially horizontally disposed lug member secured to such outer surface of at least one of such vertically disposed side wall portions. This horizontally disposed lug member is secured to such vertically disposed side wall portion adjacent a second predetermined portion of such opening formed therein. Such horizontally disposed lug member has a second predetermined length and extends outwardly from such vertically disposed side wall portion for a second predetermined distance. Such assembly mechanism further includes a locking member. Such locking member is engageable with each of such vertically disposed lug member, such horizontally disposed lug member and a portion of such shaft member engaged in such opening for removably securing such shaft member in such opening. Additionally, this assembly mechanism includes a locking means engageable with such locking member and each of such vertically disposed lug member and such horizontally disposed lug member to lock in a semi-permanent fashion such locking member to each of such vertically disposed lug member and such horizontally disposed lug member.

OBJECTS OF THE INVENTION

It is, therefore, one of the primary objects of the present invention to provide an assembly mechanism for removably securing a bearing assembly carried by a male connection member to a female connection member of an articulated coupling system used for connecting adjacent predetermined ends of a pair of railway cars together in a substantially semi-permanent manner, which is easily assembled and disassembled.

Another object of the present invention is to provide an assembly mechanism for removably securing a bearing assembly carried by a male connection member to a female connection member of an articulated coupling system in which a minimum number of coupling components are required.

Still another object of the present invention is to provide an assembly mechanism for removably securing a bearing assembly carried by a male connection member to a female connection member of an articulated coupling system in which none of the components forming such assembly mechanism are required to move relative to one another during operation of such articulated coupling system.

A further object of the present invention is to provide an assembly mechanism for removably securing a bearing assembly carried by a male connection member to a female connection member of an articulated coupling system in which such assembly mechanism can easily be maintained in proper working order.

It is an additional object of the present invention to provide an assembly mechanism for removably securing a bearing assembly carried by a male connection member to a female connection apparatus of an articulated coupling system in which a minimum amount of machining of the finished components will be required.

Another object of the present invention is to provide an assembly mechanism for removably securing a bearing assembly carried by a male connection member to a female connection member of an articulated coupling system which is relatively light weight.

Still another object of the present invention is to provide an assembly mechanism for removably securing a bearing assembly carried by a male connection member to a female connection member of an articulated coupling system which is relatively inexpensive to manufacture.

Yet a further object of the present invention is to provide an assembly mechanism for removably securing a bearing assembly carried by a male connection member to a female connection member of an articulated coupling system which will prevent any substantial movement of such bearing assembly during service in a train consist thereby minimizing wear on such bearing assembly.

It is a still further object of the present invention to provide an assembly mechanism for removably securing a bearing assembly carried by a male connection member to a female connection member of an articulated coupling system in which such assembly mechanism can be secured to such female connection member in a variety of ways.

In addition to the above-described objects and advantages of the assembly mechanism for removably securing a bearing assembly to an articulated coupling system, various other objects and advantages of the present invention will become more readily apparent to those persons who are skilled in the railroad articulated coupling art from the following more detailed descriptions of such invention, particularly, when such description is taken in conjunction with both the attached drawing figures and with the appended claims.

BRIEF DESCRIPTION OF THE INVENTION

Figure 1:
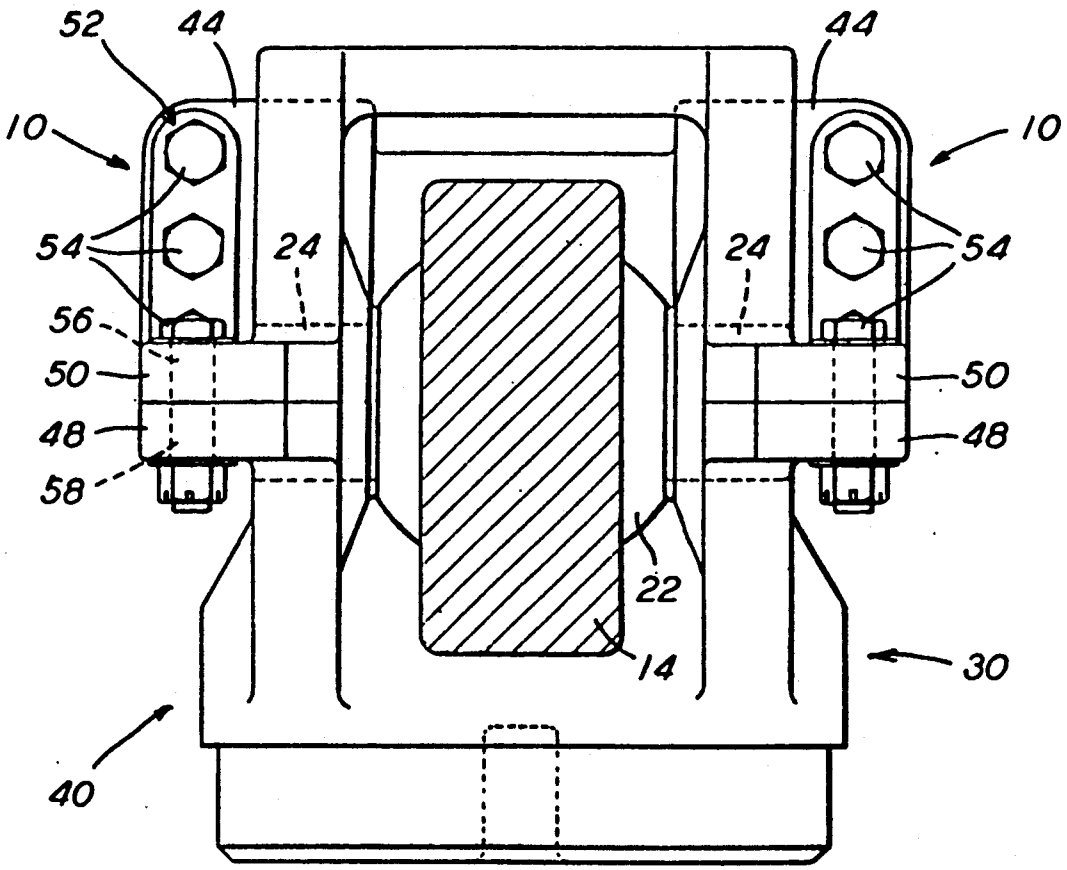
FIG. 1 is a front elevation view in which there is illustrated one presently preferred embodiment of an assembly mechanism to enable removably securing a bearing assembly carried by a male connection member to a female connection member of an articulated coupling system.

Prior to proceeding to the more detailed description of the assembly mechanism, constructed according to the instant invention, it should be noted that in each of the several views illustrated in the attached drawings, identical components which provide identical functions have been identified, for the sake of clarity, with identical reference numerals.

Figure 2:
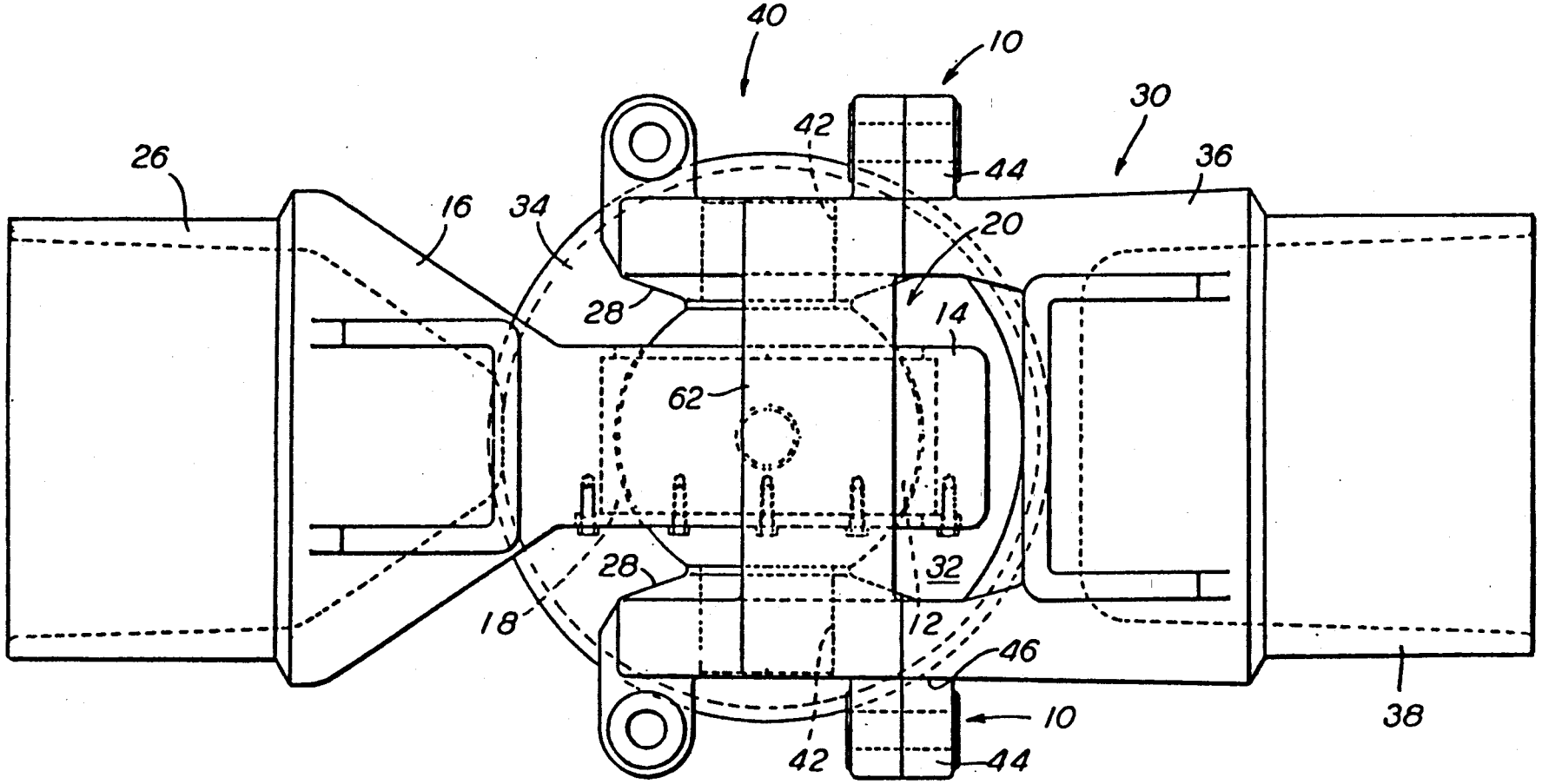
FIG. 2 is a top view of the presently preferred assembly mechanism illustrated in FIG. 1.
Figure 3:
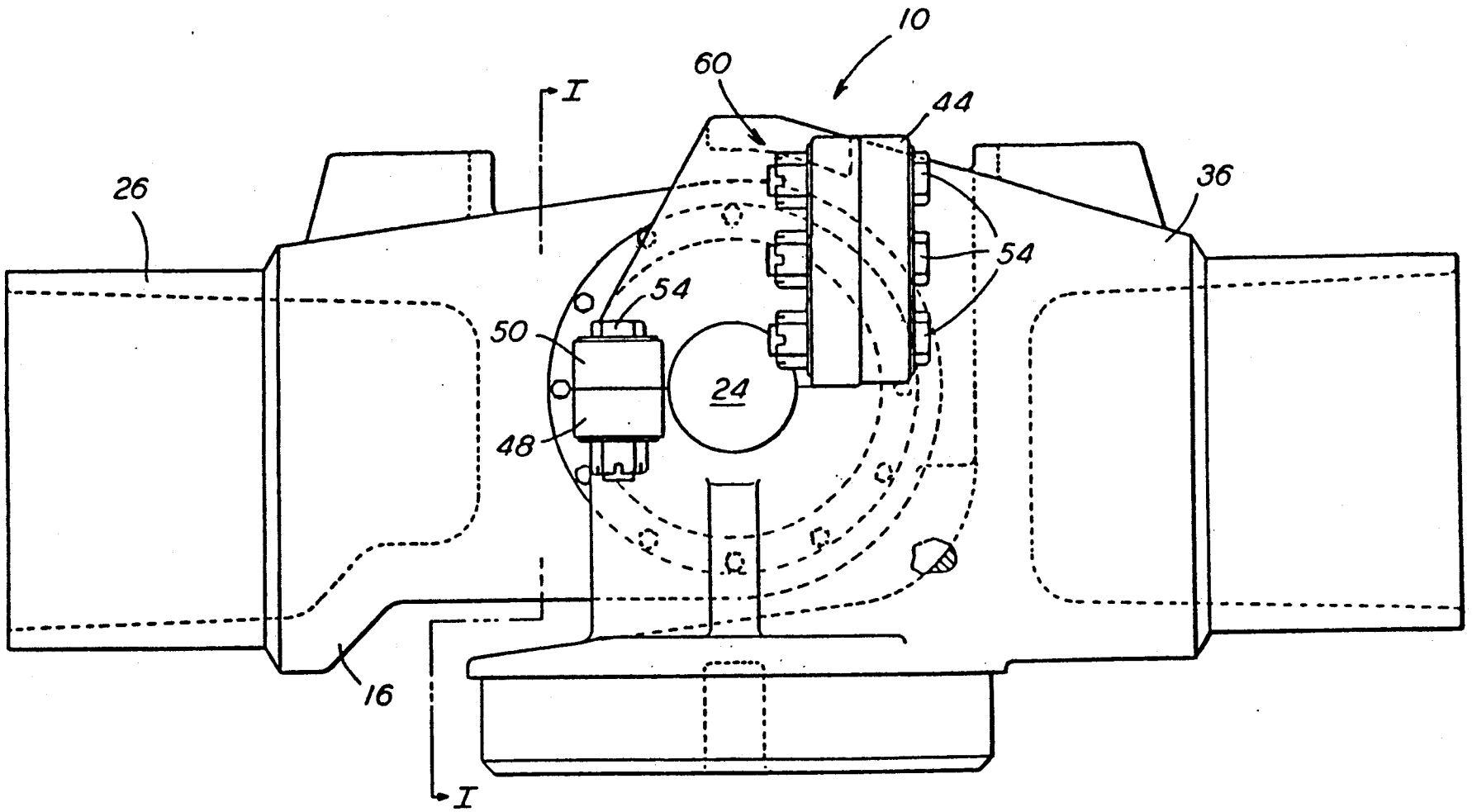
FIG. 3 is a side elevation view of such presently preferred assembly mechanism illustrated in FIGS. 1 and 2.

Now reference is made more particularly to FIGS. 1 through 3 in which there is illustrated one presently preferred embodiment of an assembly mechanism, generally designated 10, provided so that a bearing assembly, generally designated 20, can be removably secured to a female connection member, generally designated 30, of an articulated coupling system, generally designated 40.

The bearing assembly 20 has at least a predetermined portion 12 thereof disposed in and secured to an outer end portion 14 of a male connection member 16. Such bearing assembly 20 is secured to such male connection member 16 by means of a race assembly 18. The bearing assembly 20 includes a substantially spherical member 22 having a pair of shaft-like members 24 which extend outwardly a predetermined length from axially opposed surfaces of such spherical member. The male connection member 16 is engageable with and connectable to a predetermined end (not shown) of a first railway car (not shown) at an axially opposed end portion 26 thereof.

The assembly mechanism 10 includes at least a portion thereof that is removably secured to at least one of a pair of vertically disposed and axially opposed side wall portions 28 of a cavity 32 disposed at an outer end portion 34 of a female connection member 36. Such female connection member 36 is engageable with and connectable to an adjacent predetermined end (not shown) of a second railway car (not shown) at an axially opposed second end portion 38 thereof. Each shaft-like member 24 is engageable in a respective opening 42 formed through each of such pair of vertically disposed and axially opposed side wall portions 28 of such cavity 32.

Such assembly mechanism 10 includes at least one substantially vertically disposed lug member 44. The lug member 44 is secured to an outer surface 46 of at least one of such vertically disposed side wall portions 28 adjacent a first predetermined portion of such opening 42 formed therein. Such lug member 44 is preferably formed integrally with such vertically disposed side wall portion 28. Such vertically disposed lug member 44 has a first predetermined length and extends outwardly from such outer surface 46 of such vertically disposed side wall portion 28 for a first predetermined distance.

Assembly mechanism 10 also includes at least one substantially horizontally disposed lug member 48. The lug member 48 is secured to such outer surface 4 of such at least one of such vertically disposed side wall portions 28 of such cavity 32 adjacent a second predetermined portion of such opening 42. Preferably lug member 48 is formed integrally with such vertically disposed side wall portion 28 the same as lug member 44. Such horizontally disposed lug member 48 has a second predetermined length and extends outwardly from such outer surface 46 of such vertically disposed side wall portion 28 for a second predetermined distance. In the presently preferred embodiment, the first predetermined length of such vertically disposed lug member 44 will longer than the second predetermined length of such horizontally disposed lug member 48. Additionally, it is presently preferred that the first predetermined distance such vertically disposed lug member 44 extends outwardly from such outer surface 46 will be substantially identical to such second predetermined distance such horizontally disposed lug member 48 extends outwardly from such outer surface 46 of the vertically disposed side wall portion 28.

The assembly mechanism 10 further includes a locking member 50. Such locking member 50 is engageable with each of such vertically disposed lug member 44 and such horizontally disposed lug member 48. Further, such locking member 50 engages at least a portion of such shaft-like member 24 which is engaged in such opening 42 so that such shaft-like member 24 is removably secured in such opening 42.

Additionally, such bearing assembly 10 includes a locking means 52 (shown in the drawings as bolts 54) which is engageable with each of such locking member 50 and such vertically disposed lug member 44 and such horizontally disposed lug member 48 thereby completing the connections of adjacent ends of such first railway car and such second railway car together in a substantially semi-permanent manner. When such locking means 52 is at least one bolt 54, locking member 50 will include at least one aperture 56 formed therethrough. Such aperture 56 will be positioned such that it will be axially aligned with at least one aperture 58 formed through at least one of such vertically disposed lug member 44 and such horizontally disposed lug member 48. In this arrangement, such locking means 52, i.e. bolts 54, is engageable through such aperture 56 in such locking member 50 and such aperture 58 in such at least on of such vertically disposed lug member 44 and such horizontally disposed lug member 48. In a more preferred arrangement such locking member 50 will include a plurality of apertures 56 formed therethrough. Such plurality of apertures 56 will be positioned in the locking member 50 such that they will be disposed in axial alignment respectively with an aperture 58 formed through such horizontally disposed lug member 48 and at least one aperture 58 formed through such vertically disposed lug member 44. As can be seen in FIGS. 1 and 3, it is most preferred for such vertically disposed lug member 44 to have a plurality of apertures 58, three such apertures 58 being illustrated. In this case, a plurality of bolts 54 being required.

It is also desirable for such assembly mechanism 10 to include a means 60 (shown in the drawing as a cotter pin 60, although when bolts 54 are used it is within the scope of the present invention for such means 60 to be weldments, adhesive, etc.) for preventing the locking means 52 from becoming accidentally loosened.

According to the most preferred embodiment, of the present invention, an assembly mechanism 10 as described above is provided on each of such pair of vertically disposed and axially opposed side wall portions 28. As can best be seen in FIGS. and 2, such bearing assembly 10, in this most preferred embodiment includes a cap-like member 62. This cap-like member 62 is secured to each of the locking members 50 adjacent an upper surface thereof. Such cap-like member 62 facilitates alignment of the apertures 56 formed in such locking members 50 with the apertures 58 formed in the vertically disposed lug members 44 and the horizontally disposed lug members 48 during assembly of the articulated coupling arrangement. As can also be seen in FIGS. 1 and 2, such locking members 50 and such cap-like member 62 can be formed as an integral simple piece.

In this embodiment it is preferred that the predetermined length of each of such vertically disposed lug members 44 will be substantially the same. Likewise, the predetermined length of each of such horizontally disposed lug members 48 will be substantially the same and such predetermined length of such vertically disposed lug members 44 will be longer than the predetermined length of such horizontally disposed lug members 48. Further, the predetermined distance each of the vertically disposed lug members 44 and the horizontally disposed lug members 48 extend outwardly from their respective outer surfaces 46 of the vertically disposed and axially opposed side wall portions 28 will be substantially identical. In other words, within casting tolerances since these components will normally be cast with such female connection member 36. However, it is within the scope of the present invention for such vertically disposed lug members 44 and such horizontally disposed lug members 48 to be welded to such outer surfaces 46 of such pair of vertically disposed and axially opposed side wall portions 28.

While a number of preferred and alternative embodiments of the assembly mechanism for removably securing a bearing assembly to a female connection member of an articulated coupling apparatus, constructed according to the present invention, have been described in considerable detail above, it will be obvious to those persons who are skilled in the railway coupling art that various other modifications and adaptations of such assembly mechanism can be made without departing from the spirit and scope of the appended claims.

We claim:

1. An assembly mechanism for removably securing a bearing assembly, having at least a predetermined portion thereof disposed in and secured to an outer end portion of a male connection member which is engageable with and connectable to a predetermined end of a first railway car at an axially opposite end portion thereof, to at least one of a pair of vertically disposed and axially opposed side wall portions of a cavity disposed at an outer end portion of a female connection member, which is engageable with and connectable to an adjacent predetermined end of a second railway car at an axially opposite second end portion thereof, said assembly mechanism thereby connecting adjacent ends of such first railway car and such second railway car together in a substantially semi-permanent manner, such bearing assembly includes a pair of shaft-like members which extend outwardly a predetermined length from axially opposed surfaces of a substantially spherical member, each shaft-like member is engageable in a respective opening formed through each of such pair of vertically disposed and axially opposed side wall portions of such cavity disposed on such outer end portion of such female connection member, said assembly mechanism comprising:

a. at least one substantially vertically disposed lug member secured to a first portion of an outer surface of at least one of such vertically disposed and axially opposed side wall portions adjacent a predetermined portion of such opening formed therein, said vertically disposed lug member having a first predetermined length and extending outwardly from such outer surface of such vertically disposed and axially opposed side wall portion for a first predetermined distance;

b. at least one substantially horizontally disposed lug member secured to a second portion of such outer surface of such at least one of such vertically disposed and axially opposed side wall portions adjacent another predetermined portion of such opening formed therein, said horizontally disposed lug member having a second predetermined length and extending outwardly from such outer surface of such vertically disposed and axially opposed side wall portion for a second predetermined distance;

c. at least one locking member engageable with each of said vertically disposed lug member, and said horizontally disposed lug member, and a portion of such shaft-like member engaged in such opening in such vertically disposed and axially opposed side wall portion for removably securing such shaft-like member in such opening; and d. at least one locking means engageable with each of said locking member, and said vertically disposed lug member, and said horizontally disposed lug member for locking said locking member securely to said vertically disposed lug member and said horizontally disposed lug member.

2. An assembly mechanism for removably securing a bearing assembly carried by a male connection member to a female connection member of an articulated coupling system, according to claim wherein said vertically disposed lug member is formed integrally with such vertically disposed and axially opposed side wall portion.

3. An assembly mechanism for removably securing a bearing assembly carried by a male connection member to a female connection member of an articulated coupling system, according to claim 2, wherein said horizontally disposed lug member is formed integrally with such vertically disposed and axially opposed side wall portion.

4. An assembly mechanism for removably securing a bearing assembly carried by a male connection member to a female connection member of an articulated coupling system, according to claim 3, wherein said first predetermined length of said vertically disposed lug member is longer than said second predetermined length of said horizontally disposed lug member, and said first predetermined distance said vertically disposed lug member extends outwardly from such outer surface of such vertically disposed and axially opposed side wall portion is substantially identical to said second predetermined distance said horizontally disposed lug member extends outwardly from such outer surface of such vertically disposed and axially opposed side wall portion.

5. An assembly mechanism for removably securing a bearing assembly carried by a male connection member to a female connection member of an articulated coupling system, according to claim 4, wherein said locking member includes a plurality of apertures formed therethrough which are disposed in axial alignment respectively with an aperture formed through said horizontally disposed lug member and a plurality of apertures formed through said vertically disposed lug member and said locking means is a plurality of bolts engageable through said apertures.

6. An assembly mechanism for removably securing a bearing assembly carried by a male connection member to a female connection member of an articulated coupling system, according to claim 3, wherein said locking member includes a plurality of apertures formed therethrough which are disposed in axial alignment respectively with an aperture formed through said horizontally disposed lug member and a plurality of apertures formed through said vertically disposed lug member and said locking means is a plurality of bolts engageable through said apertures.

7. An assembly mechanism for removably securing a bearing assembly carried by a male connection member to a female connection member of an articulated coupling system, according to claim 1, wherein said first predetermined length of said vertically disposed lug member is longer than said second predetermined length of said horizontally disposed lug member.

8. An assembly mechanism for removably securing a bearing assembly carried by a male connection member to a female connection member of an articulated coupling system, according to claim 7, where said first predetermined distance said vertically disposed lug member extends outwardly from such outer surface of such vertically disposed and axially opposed side wall portion is substantially identical to said second predetermined distance said horizontally disposed lug member extends outwardly from such outer surface of such vertically disposed and axially opposed side wall portion.

9. An assembly mechanism for removably securing a bearing assembly carried by a male connection member to a female connection member of an articulated coupling system, according to claim 1, wherein said locking member includes at least one aperture formed therethrough which is disposed in axial alignment with at least one aperture formed through at least one of said vertically disposed lug member and said horizontally disposed lug member and said locking means is engageable through said aperture in said locking member and said aperture in said at least one of said vertically disposed lug member and said horizontally disposed lug member.

10. An assembly mechanism for removably securing a bearing assembly carried by a male connection member to a female connection member of an articulated coupling system, according to claim 5, wherein said locking member includes a plurality of apertures formed therethrough which are disposed in axial alignment respectively with an aperture formed through said horizontally disposed lug member and at least one aperture formed through said vertically disposed lug member.

11. An assembly mechanism for removably securing a bearing assembly carried by a male connection member to a female connection member of an articulated coupling system, according to claim 10, wherein said vertically disposed lug member includes a plurality of apertures formed therethrough.

12. An assembly mechanism for removably securing a bearing assembly carried by a male connection member to a female connection member of an articulated coupling system, according to claim 11, wherein said locking means is a plurality of bolts.

13. An assembly mechanism for removably securing a bearing assembly carried by a male connection member to a female connection member of an articulated coupling system, according to claim 9, wherein said locking means is at least one bolt.

14. An assembly mechanism for removably securing a bearing assembly carried by a male connection member to a female connection member of an articulated coupling system, according to claim 1, wherein said assembly mechanism further includes a means engageable with said locking means for preventing said locking means from being inadvertently loosened.

15. An assembly mechanism for removably securing a bearing assembly carried by a male connection member to a female connection member of articulated coupling system, according to claim 14, wherein said assembly mechanism further includes plurality of cotter pins to prevent said bolts from becoming inadvertently loosened.

16. An assembly mechanism for removably securing a bearing assembly, having at least a predetermined portion thereof disposed in and secured to an outer end portion of a male connection member which is engageable with and connectable to a predetermined end of a first railway car at an axially opposite end portion thereof, to each of a pair of vertically disposed and axially opposed side wall portions of a cavity disposed at an outer end portion of a female connection member, which is engageable with and connectable to an adjacent predetermined end of a second railway car at an axially opposed second end portion thereof, said assembly mechanism thereby connecting adjacent ends of such first railway car and such second railway car together in a substantially semi-permanent manner, such bearing assembly includes a pair of shaft-like members which extend outwardly a predetermined length from axially opposed surfaces of a substantially spherical member, each shaft-like member is engageable in a respective opening formed through each of such pair of vertically disposed and axially opposed side wall portions of such cavity disposed on such outer end portion of such female connection member, said assembly mechanism comprising:

a. a first substantially vertically disposed lug member secured to a first portion of an outer surface of a first of such pair of vertically disposed and axially opposed side wall portions adjacent a first predetermined portion of such opening formed therein, said first vertically disposed lug member having a first predetermined length and extending outwardly from such outer surface of such first of such pair of vertically disposed and axially opposed side wall portions for a first predetermined distance;

b. a second substantially vertically disposed lug member secured to a first portion of an outer surface of a second of such pair of vertically disposed and axially opposed side wall portions adjacent a first predetermined portion of an opening formed therein, said second vertically disposed lug member having a second predetermined length and extending outwardly from such outer surface of such second of such pair of vertically disposed and axially opposed side wall portions for a second predetermined distance;

c. a first substantially horizontally disposed lug member secured to a second portion of such outer surface of such first of such pair of vertically disposed and axially opposed side wall portions adjacent a second predetermined portion of such opening formed therein, said first horizontally disposed lug member having a third predetermined length and extending outwardly from such outer surface of such first of such pair of vertically disposed and axially opposed side wall portions for a third predetermined distance;

d. a second substantially horizontally disposed lug member secured to a second portion of such outer surface of such second of such pair of vertically disposed and axially opposed side wall portions adjacent a second predetermined portion of an opening formed therein, said second horizontally disposed lug member having a fourth predetermined length and extending outwardly from such outer surface of such second of such pair of vertically disposed and axially opposed side wall portions for a fourth predetermined distance;

e. a first locking member engageable with each of said first vertically disposed lug member, and said first horizontally disposed lug member, and a portion of a first of such pair of shaft-like members engaged in such opening formed in such first of such pair of vertically disposed and axially opposed side wall portions for removably securing such first shaft-like member against rotation in such opening;

f. a second locking member engageable with each of said second vertically disposed lug member, and said second horizontally disposed lug member, and a portion of a second of such pair of shaft-like members engaged in such opening formed in such second of such pair of vertically disposed and axially opposed side wall portions for removable securing such second shaft-like member against rotation in such opening;

g. a first locking means engageable with each of said first locking member, and said first vertically disposed lug member, and said first horizontally disposed lug member for locking said first locking member securely to said first vertically disposed lug member and said first horizontally disposed lug member; and h. a second locking means engageable with each of said second locking member, and said second vertically disposed lug member, and said second horizontally disposed lug member for locking said second locking member securely to said second vertically disposed lug member and said second horizontally disposed lug member.

17. An assembly mechanism for removably securing a bearing assembly carried by a male connection member to a female connection member of an articulated coupling system, according to claim 16, wherein said assembly mechanism further includes a cap-like member secured to each of said first locking member and said second locking member adjacent an upper surface of each of said first locking member and said second locking member for facilitating alignment during assembly.

18. An assembly mechanism for removably securing a bearing assembly carried by a male connection member to a female connection member of an articulated coupling system, according to claim 17, wherein each of said first locking member, and said second locking member, and said cap-like member are formed integrally as a single piece.

19. An assembly mechanism for removably securing a bearing assembly carried by a male connection member to a female connection member of an articulated coupling system, according to claim 17, wherein each of said first vertically disposed lug member and said first horizontally disposed lug member are formed integrally with such first of such pair of vertically disposed and axially opposed side wall portions.

20. An assembly mechanism for removably securing a bearing assembly carried by a male connection member to a female connection member of an articulated coupling system, according to claim 19, wherein each of said first vertically disposed lug member and said first horizontally disposed lug member are formed integrally with such first of such pair of vertically disposed and axially opposed side wall portions and each of said second vertically disposed lug member and said second horizontally disposed lug member are formed integrally with said second of such pair of vertically disposed and axially opposed side wall portions.

21. An assembly mechanism for removably securing a bearing assembly carried by a male connection member to a female connection member of an articulated coupling system, according to claim 19, wherein said first predetermined length and said second predetermined length of said first vertically disposed lug member and said second vertically disposed lug member, respectively, is longer than said third predetermined length and said fourth predetermined length of said first horizontally disposed lug member and said second horizontally disposed lug member, respectively.

22. An assembly mechanism for removably securing a bearing assembly carried by a male connection member to a female connection member of an articulated coupling system, according to claim 17, wherein said first predetermined length of said first vertically disposed lug member is substantially identical to said second predetermined length of said second vertically disposed lug member.

23. An assembly mechanism for removably securing a bearing assembly carried by a male connection member to a female connection member of an articulated coupling system, according to claim 22, wherein said first predetermined length and said second predetermined length of said first vertically disposed lug member and said second vertically disposed lug member, respectively, is longer than said third predetermined length and said fourth predetermined length of said first horizontally disposed lug member and said second horizontally disposed lug member, respectively.

24. An assembly mechanism for removably securing a bearing assembly carried by a male connection member to a female connection member of an articulated coupling system, according to claim 22, wherein said first predetermined length and said second predetermined length of said first vertically disposed lug member and said second vertically disposed lug member, respectively, is longer than said third predetermined length and said fourth predetermined length of said first horizontally disposed lug member and said second horizontally disposed lug member, respectively, and said first predetermined distance associated with said first vertically disposed lug member and said third predetermined distance associated with said first horizontally disposed lug member are substantially identical to said second predetermined distance associated with said second vertically disposed lug member and said fourth predetermined distance associated with said second horizontally disposed lug member.

25. An assembly mechanism for removably securing a bearing assembly carried by a male connection member to a female connection member of an articulated coupling system, according to claim 17, wherein said first predetermined distance said first vertically disposed lug member extends outwardly from such outer surface of such first of such pair of vertically disposed lug and axially opposed side wall portions is substantially identical to said third predetermined distance said first horizontally disposed lug member extends outward from such outer surface of such first of such pair of vertically disposed and axially opposed side wall portions.

26. An assembly mechanism for removably securing a bearing assembly carried by a male connection member to a female connection member of an articulated coupling system, according to claim 25, wherein said first predetermined length and said second predetermined length of said first vertically disposed lug member and said second vertically disposed lug member, respectively, is longer than said third predetermined length and said fourth predetermined length of said first horizontally disposed lug member and said second horizontally disposed lug member, respectively, and said first predetermined distance associated with said first vertically disposed lug member and said third predetermined distance associated with said first horizontally disposed lug member are substantially identical to said second predetermined distance associated with said second vertically disposed lug member and said fourth predetermined distance associated with said second horizontally disposed lug member.

27. An assembly mechanism for removably securing a bearing assembly carried by a male connection member to a female connection member of an articulated coupling system, according to claim 16, wherein each of said second vertically disposed lug member and said second horizontally disposed lug member are formed integrally with such second of such pair of vertically disposed and axially opposed side wall portions.

28. An assembly mechanism for removably securing a bearing assembly carried by a male connection member to a female connection member of an articulated coupling system, according to claim 16, wherein said third predetermined length of said first horizontally disposed lug member is substantially identical to said predetermined length of said second horizontally disposed lug member.

29. An assembly mechanism for removably securing a bearing assembly carried by a male connection member to a female connection member of an articulated coupling system, according to claim 16, wherein said predetermined length and said second predetermined length of said first vertically disposed lug member and said second vertically disposed lug member, respectively, is longer than said third predetermined length and said fourth predetermined length of said first horizontally disposed lug member and said second horizontally disposed lug member, respectively.

30. An assembly mechanism for removably securing a bearing assembly carried by a male connection member to a female connection member of an articulated coupling system, according to claim 16, wherein said second predetermined distance said second vertically disposed lug member extends outwardly from such outer surface of such second of such pair of vertically disposed and axially opposed side wall portions is substantially identical to said fourth predetermined distance said second horizontally disposed lug member extends outwardly from such outer surface of such second of such pair of vertically disposed and axially opposed side wall portions.

31. An assembly mechanism for removably securing a bearing assembly carried by a male connection member to a female connection member of an articulated coupling system, according to claim 16, wherein said first predetermined distance associated with said first vertically disposed lug member and said third predetermined distance associated with said first horizontally disposed lug member are substantially identical to said second predetermined distance associated with said second vertically disposed lug member and said fourth predetermined distance associated with said second horizontally disposed lug member.

32. An assembly mechanism for removably securing a bearing assembly carried by a male connection member to a female connection member of an articulated coupling system, according to claim 16, wherein said first locking member includes at least one aperture formed therethrough which is disposed in axial alignment with at least one aperture formed through at least one of said first vertically disposed lug member and said first horizontally disposed lug member and said first locking means is engageable through said aperture formed through said first locking member and said aperture formed through said at least one of said first vertically disposed lug member and said first horizontally disposed lug member.

33. An assembly mechanism for removably securing a bearing assembly carried by a male connection member to a female connection member of an articulated coupling system, according to claim 32, wherein said second locking member includes at least one aperture formed therethrough which is disposed in axial alignment with at least one aperture formed through at least on of said second vertically disposed lug member and said second horizontally disposed lug member and said second locking means is engageable through said aperture formed through said second locking member and said aperture formed through said at least one of said second vertically disposed lug members and said second horizontally disposed lug member.

34. An assembly mechanism for removably securing a bearing assembly carried by a male connection member to a female connection member of an articulated coupling system, according to claim 16, wherein said first locking member includes a plurality of apertures formed therethrough which are disposed in axial alignment, respectively, with an aperture formed through said first horizontally disposed lug member and at least one aperture formed through said first vertically disposed lug member.

35. An assembly mechanism for removably securing a bearing assembly carried by a male connection member to a female connection member of an articulated coupling system, according to claim 34, wherein said second locking member includes a plurality of apertures formed therethrough which are disposed in axial alignment, respectively, with an aperture formed through said second horizontally disposed lug member and at least one aperture formed through said second vertically disposed lug member.

36. An assembly mechanism for removably securing a bearing assembly carried by a male connection member to a female connection member of an articulated coupling system, according to claim 16, wherein each of said first vertically disposed lug member and said second vertically disposed lug member includes a plurality of apertures.

37. An assembly mechanism for removably securing a bearing assembly carried by a male connection member to a female connection member of an articulated coupling system, according to claim 16, wherein said first locking means is a plurality of bolts.

38. An assembly mechanism for removably securing a bearing assembly carried by a male connection member to a female connection member of an articulated coupling system, according to claim 37, wherein said second locking means is a plurality of bolts.

39. An assembly mechanism for removably securing a bearing assembly carried by a male connection member to a female connection member of an articulated coupling system, according to claim 38, wherein said assembly mechanism further includes a means engageable with said bolts for preventing said bolts from becoming inadvertently loosened.

40. An assembly mechanism for removably securing a bearing assembly carried by a male connection member to a female connection member of an articulated coupling system, according to claim 39, wherein said means for preventing said bolts from becoming inadvertently loosened is a plurality of cotter pins.

* * * * *

UNITED STATES PATENT AND TRADEMARK OFFICE

CERTIFICATE OF CORRECTION

PATENT NO. : 5,080,243

DATED : JANUARY 14, 1992

INVENTOR(S) : Edward G. Lynch et al.

It is certified that error appears in the above-identified patent and that said Letters Patent is hereby corrected as shown below:

Column 6, line 25, delete "4" and insert --46--;

Column 6, line 37, after will, insert --be--.

Column 7, line 2, delete "on" and insert --one--;

Column 7, line 27, after FIGS, insert --1--.

In the Abstract, line 21, delete "verticl" and insert --vertical--.

Signed and Sealed this

Eighth Day of February, 1994

Bruce Lehman

*Attest:*

BRUCE LEHMAN

*Attesting Officer*

*Commissioner of Patents and Trademarks*